US005113687A

United States Patent [19]

Palmgren

[11] Patent Number: 5,113,687

[45] Date of Patent: May 19, 1992

[54] STUD PULLER

[75] Inventor: Carl T. Palmgren, Petaluma, Calif.

[73] Assignee: Morgan Manufacturing Inc., Petaluma, Calif.

[21] Appl. No.: 519,093

[22] Filed: May 4, 1990

[51] Int. Cl.[5] ..... B21D 01/12

[52] U.S. Cl. ..... 72/479; 72/705

[58] Field of Search ..... 72/479, 705; 403/3; 24/134 R, 134 KB; 294/132, 133, 135

[56] References Cited

U.S. PATENT DOCUMENTS

| | | | |
|---|---|---|---|
| 991,517 | 5/1911 | Kennedy | 403/3 |
| 1,646,336 | 10/1927 | Alfano et al. | 24/134 R |
| 4,827,759 | 5/1989 | Mattson | 72/705 |

*Primary Examiner*—Lowell A. Larson
*Attorney, Agent, or Firm*—Flehr, Hobach, Test, Albritton & Herbert

[57] ABSTRACT

A stud puller comprises a body that can be attached selectively to a hand pulling tool or to a slide hammer for removal of dents. A small bore at the forward end of the tool receives a pulling stud and a slot at the top of the tool at the leading end extends in communication with the stud passageway. An eccentrically mounted wheel in the slot may be turned forward to clear the stud passageway for insertion of a stud and then pulled back to engage the shank of the stud in a firm grip for pulling. The stop prevents the wheel from being turned too far and block the stud passageway until the stud is inserted.

2 Claims, 1 Drawing Sheet

STUD PULLER

BACKGROUND OF THE INVENTION

Commonly, in pulling dents from thin metal panels, particularly in automotive bodies, fenders and the like, a nail-like stud is welded to the dented area of the panel, and then the shank of the stud is gripped and pulled by some appropriate means, such as a slide hammer, to pull the dent out. In gripping the stud, conventional stud pulling tools are placed over the stud and a screw is tightened to clamp or otherwise grip the stud. Such a tool is shown in West German Patent No. 2,616,746, wherein a Knurled gripper is wedged against the stud under force of a threaded sleeve. Mattson U.S. Pat. No. 4,827,759, shows a stud pulling tool in a lever system for pulling dents, wherein the shank of the stud is quickly gripped by rotating an eccentrically mounted, knurled wheel against the shank of the studs so that pulling the stud pulls the wheel in a tightening direction to increase the gripping force. Such a stud puller has worked satisfactorily in practice, but some difficultly has been encountered in inserting the stud because the operator cannot be certain that the tool is conditioned to receive a stud.

OBJECTS OF THE INVENTION

It is an object of this invention to provide a stud puller for removing dents in sheet metal panels that is easily conditioned to receive the stud and then quickly conditioned to grip the stud firmly for pulling.

It is a further object of this invention to provide a stud pulling tool with a knurled eccentric wheel, which is easily turned in one direction to receive the stud and then turned partially in the other direction to grip the stud.

It is a further object of this invention to provide a stud pulling tool that will enable one to pull the stud by hand or by slide hammer, as selected.

Other objects and advantages of this invention will become apparent from the description to follow, particularly when read in conjunction with the accompanying drawings.

SUMMARY OF THE INVENTION

In carrying out this invention, the stud puller is easily held in the hand and has a small bore at one end, bore in the other end is tapped to secure the tool to a slide hammer, and a smaller, coaxial counterbore is tapped to receive a hand pulling tool. A slot cut in the top of the tool at the leading end thereof rotatably receives an eccentrically mounted knurled wheel which can be turned from a raised or retracted position, wherein it is clear of the stud passageway, and a lower active position wherein it engages the top shank of a stud in the passageway. A stop member prevents full rotation of the wheel in a forward direction to ensure that the passageway remains clear when the wheel is pushed forward with the thumb. Thus, the thumb wheel is pushed forward for insertion of the stud into the passageway and then pulled back to grip the stud. Any pull on the stud simply tends to rotate the wheel in the same gripping direction, causing it to grip the stud even tighter.

DESCRIPTION OF A PREFERRED EMBODIMENT

Figure 1:
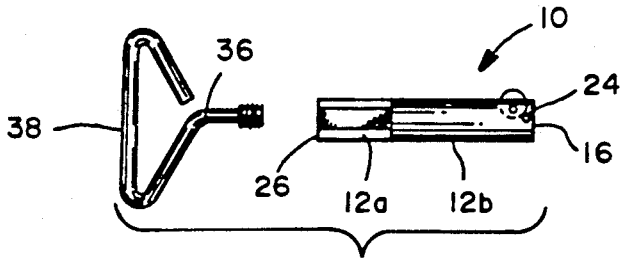
FIG. 1 is an exploded side-view of the stud puller of this invention as used with a hand pulling tool.

Referring now to the drawing with greater particularity, the stud pulling tool 10 of this invention comprises a body 12 which may be finished from hexagonal steel stock or the like. The stock may be left hexagonal at the trailing end 12*a* for gripping with a wrench (not shown), but is finished at the leading portion to form a reduced diameter cylindrical head 12*b* for convenience in handling and for to facilitate working in tight places. A small bore stud passageway 14 is drilled from the leading face 16 to enable it to receive a stud S (FIG. 3), the stud head S.H. which may be welded to the thin, sheet metal of an automotive panel (not shown).

A slot 18 is cut into the top of the body 12 at the leading end 12*b* thereof to a sufficient depth to open into the stud passageway 14. Rotatably mounted on the tool and carried in the slot 18 in the top thereof, is an eccentric wheel 20 with a knurled outer peripheral surface 22. The eccentric mounting enables the wheel to be turned between an inactive or loading position, shown in phantom in FIG. 3, wherein it is clear of the stud passageway 14, and its active or pulling position shown in solid lines, wherein it engages the shank of the studs.

Figure 3:
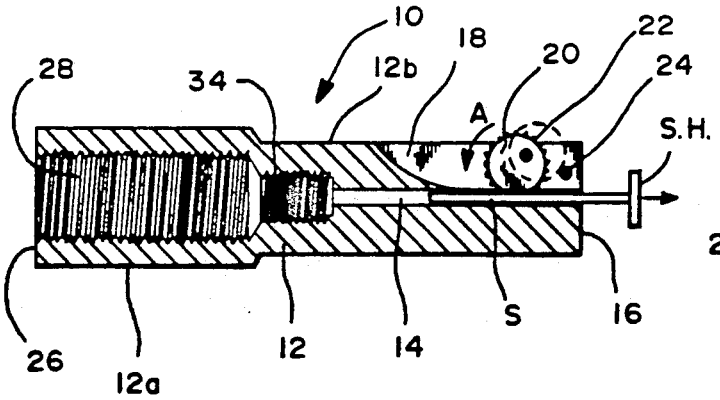
FIG. 3 is a vertical section view of the stud pulling tool taken along the axis thereof.
Figure 4:
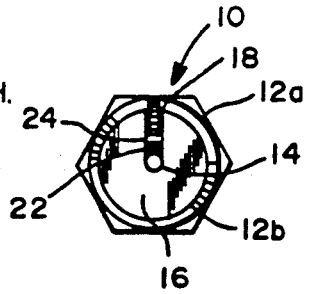
FIG. 4 is a front-end view of the stud pulling tool.

After the stud S is received in the passageway 14, the wheel 20 is turned in the counterclockwise direction in FIG 3, as indicated by the arrow A so that any tendency of the stud to be pulled from the stud passageway, as indicated by the arrow B will simply tend to pull the wheel further in the same counterclockwise direction to tighten the grip on the stud S.

Figure 2:
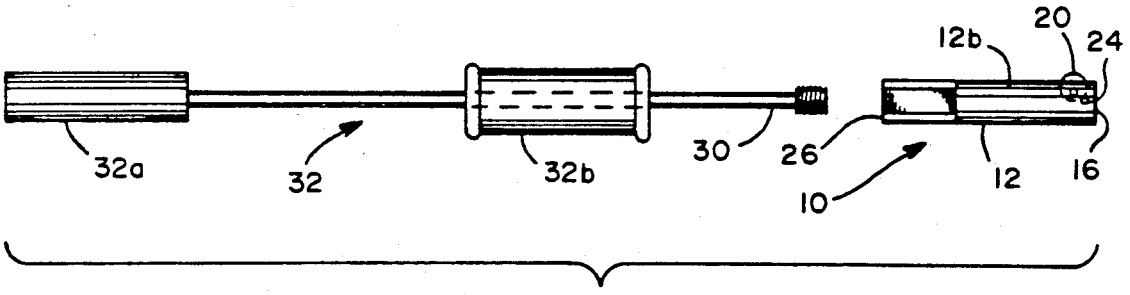
FIG. 2 is an exploded side view of the invention as used with a slide hammer.

A stop member or pin 24 is provided across the slot 18 near the leading end 16 of the tool so that it is engaged by the knurled wheel 20 to prevent the wheel 20 from being rotated or pivoted further in a clockwise direction beyond its retracted position to the active position shown in solid. Hence, the operator can easily grasp the tool 10 and push the wheel 20 forward in a clockwise direction to ensure that the stud passageway is clear 14 to receive the stud S. Then, with the stud inserted, the wheel 20 can be pulled back with the thum*b* in the counterclockwise direction to grip the stud S firmly, as previously described. Being eccentrically mounted at the top of the tool 10, the wheel 20 will tend to drop by gravity to the active position with the slightest jar, to facilitate gripping. engaged by the rod 30 of a slide hammer 32 (FIGS. 2) and a smaller counterbore 34 is tapped to receive the rod of a hand pulling tool 36, (FIG.1) which is provided with a suitable handle 38 to be gripped and pulled by the operator.

When the tool 10 is secured on the rod 30 of a slide hammer 32, with the hexagonal end 12*a* tightened in place by a wrench the handle/anvil 32*a* is gripped by the operator with one hand and the hammer 32*b* is gripped with the other to be pulled back sharply and slammed against the anvil 32a, delivering an impact force that pulls the tool back toward the operator for removal of a dent.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A stud puller comprising:

a body;

a small passageway opening from one end of said body and extending longitudinally tehreof;

a tapped bore extending longitudinally of said body from the other end thereof to receive the head of a slide hammer;

a coaxial tapped counterbore in said body to receive the end of a hand puller;

a slot in one side of said body opening into said passageway;

a knurled wheel in said slot and eccentrically mounted to rotate therein between an active position wherein the periphery thereof extends into said passageway and a loading position wherien the periphery thereof is cloear of said passageway; and stop means to prevent rotation of said wheel from said loading position to said active position in the direction in which a stud is inserted into said passageway.

2. A stud puller comprising:

a body;

a small passageway opening from one end of said body and extending longitudinally thereof;

a slot in one side of said body opening into said passageway;

a knurled wheel in said slot and eccentrically mounted to rotate therein between an active position wherein the periphery thereof extends into said passageway and a loading position wherein the periphery thereof is clear of said passageway; and a tapped bore extending longitudinally of said body from the other end thereof to receive the head of a slide hammer; and a coaxial tapped counterbore in said body to receive the end of a hand puller.

* * * * *